US005967379A

United States Patent [19]

Crossdale et al.

[11] Patent Number: 5,967,379

[45] Date of Patent: Oct. 19, 1999

[54] LIQUID DISPENSER HAVING A CONTAINER WITH A DISPENSING DEVICE

[75] Inventors: Garry William Crossdale, Derbyshire; Ken John Herbert Bird, Nottingham; Brian David Haworth, Hampshire, all of United Kingdom

[73] Assignee: Diversey Lever, Inc., Plymouth, Mich.

[21] Appl. No.: 08/768,170

[22] Filed: Dec. 17, 1996

[30] Foreign Application Priority Data

Dec. 22, 1995 [GB] United Kingdom ..... 9526386

[51] Int. Cl.[6] ..... B67D 5/06

[52] U.S. Cl. ..... 222/185.1; 222/325; 141/351

[58] Field of Search ..... 222/185.1, 325, 222/567; 141/363, 348, 351

[56] References Cited

U.S. PATENT DOCUMENTS

| | | | |
|---|---|---|---|
| 2,059,685 | 11/1936 | Feldman | 215/75 |
| 2,367,883 | 1/1945 | Miller | 215/52 |
| 3,952,918 | 4/1976 | Poitras | 222/82 |
| 4,193,576 | 3/1980 | White | 251/149.6 |
| 5,542,555 | 8/1996 | Hidding et al. | 141/351 X |

FOREIGN PATENT DOCUMENTS

| | | |
|---|---|---|
| 0 542 295 A1 | 11/1992 | European Pat. Off. . |
| 0369722 | 8/1993 | European Pat. Off. . |
| 0 675 072 A1 | 3/1995 | European Pat. Off. . |
| 358 354 | 10/1905 | France . |
| 2 114 246 | 3/1982 | United Kingdom . |
| WO 95 23095 | 8/1995 | WIPO . |
| 95/23549 | 9/1995 | WIPO . |

*Primary Examiner*—Gregory L. Huson
*Attorney, Agent, or Firm*—A. Kate Huffman

[57] ABSTRACT

A container for dispersing liquid through a dispenser is described. The container has a resealable outlet which has an outlet passageway in a tube and a stop wedged in the passageway to seal the liquid in the container. The passageway is accessible beneath the stop by a dispenser peg for insertion in the tube to push the stop inward toward the interior of the container. A means for containing the stop is adjacent the passageway inlet. The stop reseals the passageway by covering the passageway inlet after a dispenser peg is removed from the passageway.

4 Claims, 2 Drawing Sheets

LIQUID DISPENSER HAVING A CONTAINER WITH A DISPENSING DEVICE

FIELD OF THE INVENTION

The present invention relates to a dispenser and container, in particular a container of liquid—for example detergent—which is to be gradually dispensed by means of the dispensing device.

BACKGROUND OF THE INVENTION

A known container and dispensing device is shown in the Unilever N.V.'s European patent no. 0369722. The container is formed of substantially rigid plastics material and has a special cap with a slit septum. The dispensing device has a support for the container in which is arranged a hollow peg through which is pumped the liquid. The container is mounted on the dispenser by inverting the container and allowing the peg to penetrate the septum. The liquid is then pumped out and dispensed from the device as required by the user. When the container is empty, it is removed and discarded, then replaced by a new, full container.

U.S. Pat. No. 3,952,918 describes another liquid dispenser system where an upstanding puncture tube punctures a seal to supply liquid to a hand-operated pump. The pump can dispense as much liquid as desired by rapidly pumping the system. The pump piston includes a check valve which, during the fill stroke of the pump, clears liquid from the dispenser nozzle.

International PCT Application W095/23549, now owned by Unilever N.V., describes a liquid dispenser where a check valve is used to prevent product dripping from a bag hopper when the hopper is removed from the dispenser to permit cleaning of the dispenser should a leak from the pierced bag occur.

Although these systems work extremely well, there are always pressures in business to reduce the costs of products, in particular where those products are disposable. It is therefore an object of an aspect of the invention to provide a simpler and therefore potentially less expensive container with less volume and weight of plastic to dispose of.

SUMMARY OF THE INVENTION

Accordingly, the invention provides a combination of a dispenser with a protruding dispensing peg and a container, the container having a container body for holding a volume of liquid and an outlet through which the liquid can be removed, the outlet including an outlet passageway and a stop member formed of elastically or plastically deformable material, the stop member having a cross-section of a predetermined shape and at least a section of the outlet passageway having a cross-sectional shape which is smaller than that of the stop member, the stop member being moveable by the dispensing peg from a storage position in which it is retained in the outlet passageway to seal the container to a discharge position in which it is moved out of the passageway by the peg, upon placement of the container on the dispenser, to allow the liquid to be removed, and to a temporary sealing position in which it abuts the passageway when the container is removed from the dispenser, the said peg being shaped so as to allow a flow of liquid along its length.

According to an aspect of the invention, a liquid container has a resealable outlet for use on a dispenser for dispensing liquid from the container. The container outlet comprises:

i) an outlet passageway in a tube and a stop wedged in the passageway to seal liquid in the container;

ii) the passageway is accessible beneath the stop by a dispenser peg for insertion in the tube to push the stop inwardly of the passageway towards container interior;

iii) the passageway has an inlet in the container;

iv) means for containing the stop adjacent the passageway inlet when the stop has been pushed out of the passageway by a dispenser peg;

v) the stop resealing the passageway by covering the passageway inlet after a dispenser peg is removed from the passageway.

According to another aspect of the invention, the peg of the dispenser extends inwardly of the passageway beyond the inlet to push the stop out of the passageway and to space the stop away from the inlet to permit liquid to flow through the passageway.

The peg of the dispenser is preferably upstanding, the container being placed on the dispensing device with the outlet at the bottom. The peg remains inside the passageway while the liquid is dispensed, the peg preferably being hollow to allow for removal of the liquid. Alternatively, the peg could have, for example, external flutes to allow for a flow of detergent.

The invention also provides a method of dispensing including the steps of mounting the above container on a dispenser with a protruding dispensing peg.

Still further, the invention provides the above described container for use on a dispenser, preferably a container filled with liquid detergent.

If the container is removed from the dispensing device before it is emptied, then the peg will be removed from the inlet passageway and the stop member will fall back on the end of the passageway. The weight of the liquid above the stop member will tend to force it against the edge of the passageway to provide a good seal. In a preferred embodiment, the outlet part of the container also includes a spring member which urges the stop member against the end of the passageway, when the container is not on a dispensing device, to improve the seal. The spring member may be located inside a hollow filter member located around the entrance to the outlet passageway, within the container. It is generally most convenient for the outlet passageway to be circular in cross-section and for the stop member to be spherical or cylindrical. The stop member can be a polyethylene ball and indeed the remainder of the container can also be formed of polyethylene, which allows for easy recycling. The body of the container is preferably collapsible so that it is in the form of a pouch. This makes for easier disposal since the volume of the empty container is very much smaller than when it is full. A further advantage of a collapsible container is that venting is not required in order to empty it.

BRIEF DESCRIPTION OF THE DRAWINGS

A preferred embodiment of the invention is described in more detail below, with reference to the accompanying drawings, wherein.

DETAILED DESCRIPTION OF THE PREFERRED EMBODIMENTS

Figure 1:
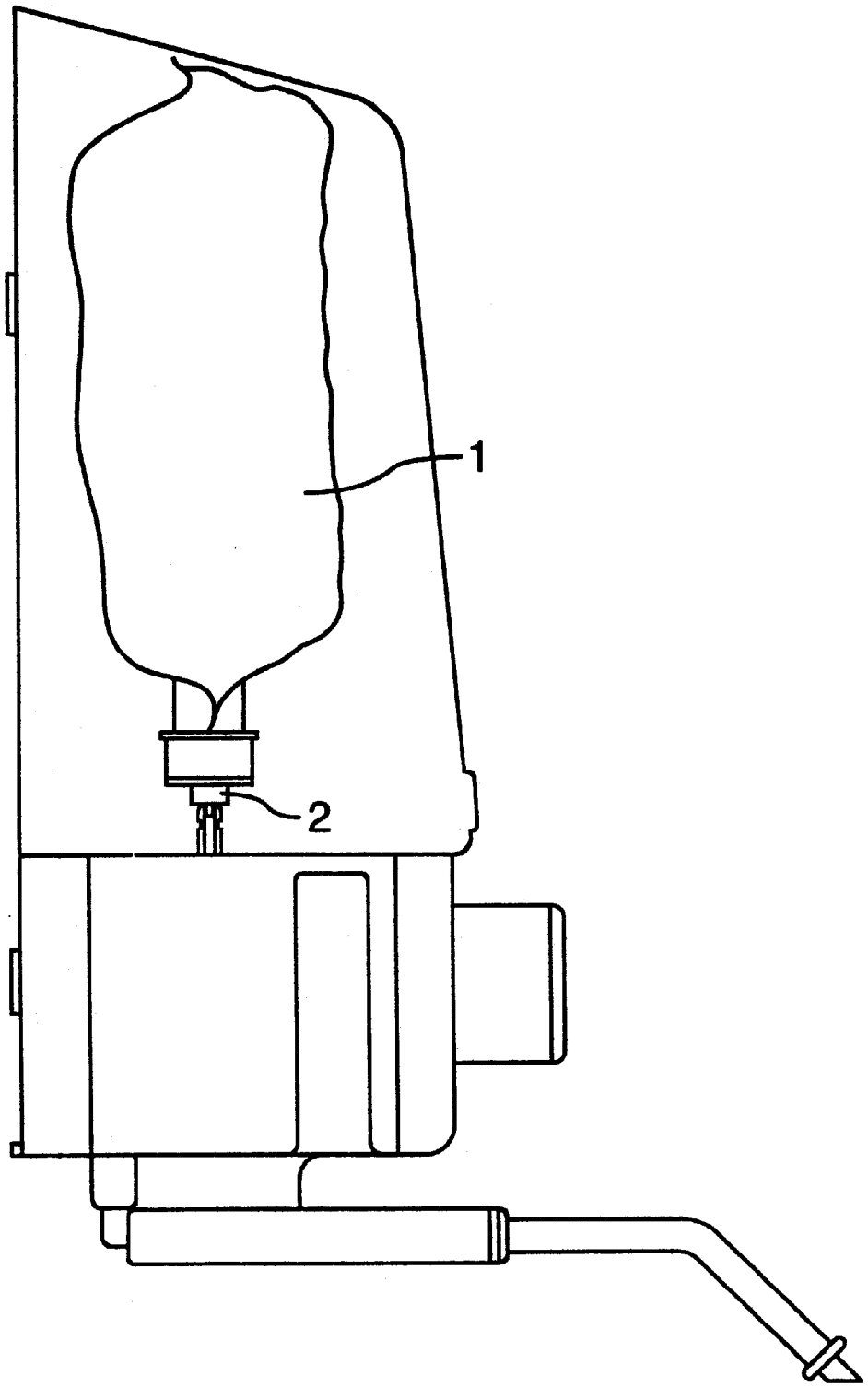
FIG. 1 shows an elevation of a container according to the invention mounted on a dispenser.

The view of FIG. 1 shows the container body 1 and the outlet 2 of the container. The dispenser shown in this figure does not need to be described in any detail. The body 1 is preferably formed of thin polyethylene sheet so that it collapses as the liquid is removed from the container.

The outlet for the container is shown in detail in FIG. 2. The outlet includes a substantially rigid polyethylene neck 3 which is sealed in an opening in the container body 1. The outlet also includes a cap 4 which can be either screwed or press fitted into the outer end of neck 3. Internally of the cap member is defined an outlet passageway 5, the inner section 6 thereof having a predetermined cross-section—which is preferably circular—of a size slightly smaller than that of stop member 7 jammed or wedged therein. Stop member 7 is preferably spherical and is forced into the inner section 6 of the outlet passageway before the cap 4 is fitted to the neck.

An inner lip 8 of the passageway defines a position beyond which the stop member cannot be pushed or, in other words, defines the extent to which the stop is wedged into the passageway. This prevents the stop member from being pushed or wedged so far in the neck that it could not easily be moved into its discharge position (for which see FIG. 2D) and also prevents the stop member being ejected from the cap member if the pouch were dropped or squeezed excessively.

Inside the neck is mounted a substantially cylindrical cage filter 9, a flange 10 at the outer end of the cage filter being located between an inner shoulder 111 of the neck and the top section 12 of the cap. The cage filter 9 serves to filter the liquid as it is dispensed, to prevent the dispenser from being blocked, and also serves to keep or maintain the stop member 7 at the inlet of the passageway for the container outlet.

Figure 2A:
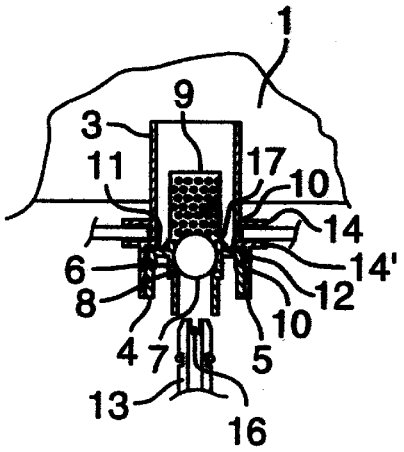
FIGS. 2A, 2B, 2C and 2D show vertical cross-sections of the outlet part of the container, illustrating the movement of the stop member of the container from the storage position to the discharge position.
Figure 2B:
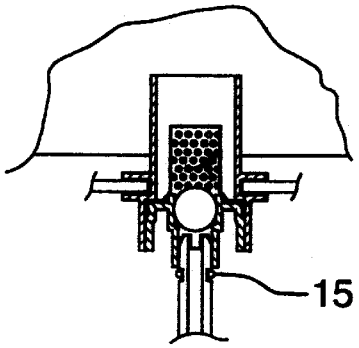

To dispense the liquid the container is inverted and mounted on a dispenser which has a hollow peg 13 which can penetrate the outlet passageway 5. Such a dispenser can be similar to that described in European patent 0369222. As the container is lowered onto the dispenser, for example by means of a manually operated lever (not shown) which can engage the neck 3 between flanges 14, 14' thereof, the hollow peg 13 travels along the passageway 5, as shown in FIG. 2B. This Figure also shows an O-ring 15 which is about to be forced into the passageway; the O-ring provides a seal between the inner surface 20 of the passageway 5 and the outer surface 21 of the peg 13, so that the liquid can only be removed from the container through the hollow peg 13.

Figure 2C:
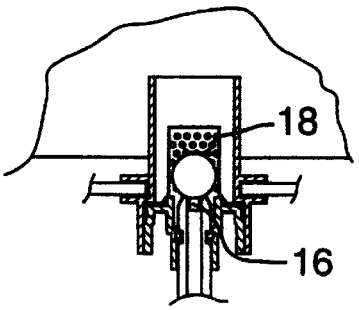
Figure 2D:
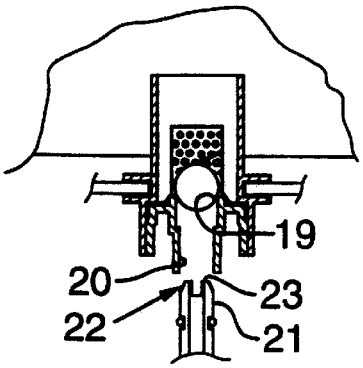

As shown in FIG. 2C, in the lowest position of the container the distal end 22 of peg 13 has pushed the stop member 7 up and out of the passageway 5 by the tip portion 23 contacting the stop 7. The liquid inside the container is now free to be dispensed through the hollow peg as required. In this embodiment, the liquid passes through outer recesses 16 arranged around the distal end 22 of the peg 13.

In normal use, the container will be left on the dispenser until all the liquid inside has been dispensed. When empty, it is removed and suitably disposed of. However, should for any reason the user remove the container while it is still part full, it will be understood that the stop member will be forced by the weight of the liquid against the rim 17 of the passageway inlet 19. The seal created here by the stop resting on the rim 17 will prevent excessive discharge of the possibly hazardous liquid in the container.

The outlet part 2 of the container can be formed with a spring member which urges the stop member against the rim of the passageway inlet 19 when the container is removed from the dispenser. The spring member is sufficiently weak that it will not tend to lift the container off the peg, when the container is properly mounted on the dispenser. Also, the spring member yields to insertion of the peg 13 in the passageway 5.

In the embodiment of FIGS. 2A to 2D, the spring member takes the form of a leaf spring 18 fitted on the inside of the cage 9. As is apparent from FIG. 2D, after the stop member 7 has been pushed out of passageway 5 and when the container I is lifted off the peg 13, the spring 18 is in a position so as to urge the stop member against the rim of the passageway inlet, to substantially seal the outlet passageway from the container.

The spring can be integrally molded with the cage from plastics material, for example polyethylene or polypropylene.

The stop member may be a polyethylene sphere of 9.52 mm. The diameter of the portion of the outlet passageway in which the stop member is jammed, in the storage position, may be for example 9.00 mm.

The invention thus provides a dispenser with a relatively simple container in which a reliable seal is created for storage of the liquid and transport of the filled container, yet which at the same time provides for easy opening of the container, for removal and dispensing of the liquid as required, and for re-sealing of the container before dispensing is completed, if necessary.

Although preferred embodiments of the invention have been described herein in detail, it will be understood by those skilled in the art that variations may be made thereto without departing from the spirit of the invention or the scope of the appended claims.

We claim:

1. A liquid container having a resealable outlet for use on a dispenser for dispensing liquid form said container, said container outlet comprising:

(i) an outlet passageway in a tube and a stop wedged in said passageway to seal liquid in said container, said passageway being a circular tube and accessible beneath said stop by a dispenser peg for insertion in said tube to push said stop inwardly of said passageway toward a container interior, said stop being a sphere of a diameter greater than said circular tube to provide a wedge fit of said sphere in said tube to seal said container, said passageway having an inlet in said container;

(ii) a filter which contains said stop adjacent said passageway inlet when said stop has been pushed out of said passageway by a dispenser peg, and said stop resealing said passageway by covering and resting upon said passageway inlet after a dispenser peg is removed from said passageway.

2. A liquid container according to claim 1 wherein said passageway is stopped to define an extent to which said stop is wedged inside passageway.

3. A container according to claim 1 wherein a dispenser in which the container is used comprises a peg for insertion in said passageway as said container is assembled on said dispenser, said peg extending inwardly of said passageway beyond said inlet to push said stop out of said passageway and to space said stop away from said inlet to permit liquid to flow through said passageway, the peg being hollow and having a distal end with recesses beneath a tip portion which supports said stop away from said inlet and said peg having an O-ring which seals a passageway interior with said peg inserted in said passageway, and said tip portion is beyond said passageway inlet.

4. A container according to claim 3 wherein said stop of said container outlet further comprises means for urging said stop against said inlet, said means yielding to peg insertion.

* * * * *